US007425159B2

(12) United States Patent
Lin

(10) Patent No.: US 7,425,159 B2
(45) Date of Patent: Sep. 16, 2008

(54) METALLIZED SLED FOR COMMUNICATION PLUG

(75) Inventor: Chen-chieh Lin, Indianapolis, IN (US)

(73) Assignee: Commscope, Inc. of North Carolina, Hickory, NC (US)

( * ) Notice: Subject to any disclaimer, the term of this patent is extended or adjusted under 35 U.S.C. 154(b) by 14 days.

(21) Appl. No.: 10/853,292

(22) Filed: May 26, 2004

(65) Prior Publication Data

US 2005/0266720 A1 Dec. 1, 2005

(51) Int. Cl.
*H01R 24/00* (2006.01)

(52) U.S. Cl. ..... 439/676

(58) Field of Classification Search ..... 439/418, 439/344, 460, 462, 676, 404, 941, 395, 504, 439/942; 29/854–856, 825, 841
See application file for complete search history.

(56) References Cited

U.S. PATENT DOCUMENTS

| | | | | |
|---|---|---|---|---|
| 5,108,270 | A * | 4/1992 | Kozumplik, Jr. | 417/393 |
| 5,774,344 | A * | 6/1998 | Casebolt | 361/800 |
| 5,899,770 | A * | 5/1999 | Ezawa | 439/418 |
| 6,056,586 | A | 5/2000 | Lin | |
| 6,238,235 | B1 * | 5/2001 | Shavit et al. | 439/418 |
| 6,250,949 | B1 | 6/2001 | Lin | |
| 6,362,432 | B1 * | 3/2002 | LaPidus et al. | 174/113 R |
| 6,406,325 | B1 * | 6/2002 | Chen | 439/418 |
| 6,625,879 | B1 * | 9/2003 | Collins et al. | 29/825 |
| 6,802,744 | B2 * | 10/2004 | Chiang | 439/701 |
| 6,811,445 | B2 * | 11/2004 | Caveney et al. | 439/676 |
| 2003/0096529 | A1 | 5/2003 | Brennan et al. | |

FOREIGN PATENT DOCUMENTS

| | | | |
|---|---|---|---|
| EP | 1 246 310 | A2 | 10/2002 |
| WO | WO-99/52182 | A1 | 10/1999 |
| WO | WO-01/08268 | A1 | 2/2001 |

* cited by examiner

*Primary Examiner*—Edwin A. León
(74) *Attorney, Agent, or Firm*—Muncy, Geissler, Olds & Lowe, PLLC

(57) ABSTRACT

A connector plug terminates a communication cable having a plurality of conductors therein. The plug includes a conductor organizing sled, which includes a plurality of channels for separating conductive wires. The sled is formed of at least two materials, including a first material being a conductive material and a second material being a dielectric material. The first material may be a metal and the second material may be a plastic. In one embodiment, the first material is impregnated within at least a portion of the second material. In another embodiment, the first material is formed as a layer on an outer surface of at least a portion of the second material.

22 Claims, 12 Drawing Sheets

Plastic Sleds (GS8E Plugs) De-embedded NEXT @ 100 MHz (N = 34)

| | Pair 1-2 | | Pair 1-3 | | Pair 1-4 | |
|---|---|---|---|---|---|---|
| **Magnitude** | **dB** | **mV** | **dB** | **mV** | **dB** | **mV** |
| **Average** | 69.34 | 0.40 | **36.92** | **14.26** | 75.33 | 0.24 |
| **Std. Dev.** | 5.55 | 0.19 | **0.22** | **0.35** | 8.31 | 0.16 |
| | | | | | | |
| **Maximum** | 82.98 | 0.72 | **37.51** | **14.88** | 98.33 | 0.58 |
| **Minimum** | 62.80 | 0.07 | **36.55** | **13.33** | 64.76 | 0.01 |
| **Difference** | 20.18 | 0.65 | **0.96** | **1.55** | 33.58 | 0.57 |

Figure 7. Background Art

Plated (Vacuum Metallizing) Sleds De-embedded NEXT @ 100 MHz (N = 18)

| | Pair 1-2 | | Pair 1-3 | | Pair 1-4 | |
|---|---|---|---|---|---|---|
| **Magnitude** | **dB** | **mV** | **dB** | **mV** | **dB** | **mV** |
| **Average** | 67.88 | 0.47 | **37.10** | **13.97** | 68.84 | 0.41 |
| **Std. Dev.** | 4.83 | 0.28 | **0.17** | **0.28** | 4.91 | 0.18 |
| | | | | | | |
| **Maximum** | 74.37 | 1.13 | **37.44** | **14.36** | 77.95 | 0.74 |
| **Minimum** | 58.94 | 0.19 | **36.86** | **13.42** | 62.61 | 0.13 |
| **Difference** | 15.44 | 0.94 | **0.59** | **0.94** | 15.34 | 0.61 |

Figure 8.

Embedded with 10% Metal Fiber Sleds De-embedded NEXT @ 100 MHz (N = 26)

| | Pair 1-2 | | Pair 1-3 | | Pair 1-4 | |
|---|---|---|---|---|---|---|
| **Magnitude** | **dB** | **mV** | **dB** | **mV** | **dB** | **mV** |
| **Average** | 66.56 | 0.49 | **37.07** | **14.02** | 70.24 | 0.35 |
| **Std. Dev.** | 2.48 | 0.14 | **0.17** | **0.28** | 5.33 | 0.15 |
| | | | | | | |
| **Maximum** | 71.23 | 0.90 | **37.48** | **14.41** | 90.88 | 0.57 |
| **Minimum** | 60.89 | 0.27 | **36.83** | **13.36** | 64.86 | 0.03 |
| **Difference** | 10.34 | 0.63 | **0.65** | **1.05** | 26.02 | 0.54 |

Figure 9.

Embedded with 15% Metal Fiber Sleds De-embedded NEXT @ 100 MHz (N = 30)

| | Pair 1-2 | | Pair 1-3 | | Pair 1-4 | |
|---|---|---|---|---|---|---|
| **Magnitude** | **dB** | **mV** | **dB** | **mV** | **dB** | **mV** |
| **Average** | 65.88 | 0.54 | **37.15** | **13.88** | 70.12 | 0.35 |
| **Std. Dev.** | 3.22 | 0.17 | **0.14** | **0.22** | 4.78 | 0.17 |
| | | | | | | |
| **Maximum** | 76.61 | 0.90 | **37.39** | **14.33** | 84.20 | 0.78 |
| **Minimum** | 60.87 | 0.15 | **36.88** | **13.50** | 62.18 | 0.06 |
| **Difference** | 15.74 | 0.76 | **0.52** | **0.83** | 22.02 | 0.72 |

Figure 10.

METALLIZED SLED FOR COMMUNICATION PLUG

BACKGROUND OF THE INVENTION

1. Field of the Invention

The present invention relates generally to the field of cable connectors. More specifically, the present invention relates to a modular plug for terminating electric wires within a cable, such as round cables or any type of cordage carrying conductor pairs.

2. Description of the Background Art

In the telecommunications industry, modular plug type connectors are commonly used to connect customer premise equipment (CPE), such as telephones or computers, to a jack in another piece of CPE, such as a modem, or in a wall terminal block. These modular plugs terminate essentially two types of cable or cordage: ribbon type cables and round cables.

In ribbon type cables, the conductors running therethrough are arranged substantially in a plane and run, substantially parallel, alongside each other throughout the length of the cable. The individual conductors may have their own insulation or may be isolated from one another by channels defined in the jacket of the ribbon cable itself, with the ribbon jacket providing the necessary insulation. Conversely, the conductors packaged in a standard round cable may take on a random or intended arrangement with conductors being twisted or wrapped around one another and changing relative positions throughout the cable length.

Traditional modular plugs are well suited for terminating ribbon type cables. Typically, these plugs are of a dielectric, such as plastic, structure in which a set of terminals are mounted side by side in a set of troughs or channels in the plug body such that the terminals match the configuration of the conductors in the cable connected thereto. When the plug is inserted into a jack, the terminals electrically engage jack springs inside the jack to complete the connection.

On the other hand, termination of standard round cables or cords poses unique assembly problems for the skilled technician. For example, termination of a round cable carrying, for example, four conductor pairs by means of an existing modular plug requires the following steps: First, the cable or cord jacket must be stripped to access the enclosed conductors. Next, because the conductors in a conductor pair are generally twisted around one another, the twist must be removed and the conductors oriented to align with the required interface. For some standardized plugs, aligning the conductors also involves separating the conductors in at least one of the pairs and routing these over or under conductors from other pairs while orienting all the conductors in a side-by-side plane, thus, the orientation process can result in various conductors of different pairs crossing over each other, thereby inducing crosstalk among the several conductor pairs.

Crosstalk is defined as the cross coupling of electromagnetic energy between adjacent conductor pairs in the same cable bundle or binder. Crosstalk can be categorized in one of two forms: Near End Crosstalk, commonly referred to as NEXT, is the most significant because the high energy signal from an adjacent conductor can induce relatively significant crosstalk into an attenuated receiver signal. The other form is Far End Crosstalk or FEXT. FEXT is typically less of an issue because the far end interfering signal is attenuated as it traverses the loop. Because the jack springs, conductors and the plug terminals or contacts near the jack springs are generally quite close to, and exposed to, one another in a communication plug, control of crosstalk is a paramount consideration in any plug design. Unfortunately, crosstalk in a communication plug cannot be merely eliminated. Jacks are engineered to generate a certain amount of compensating crosstalk to counter the crosstalk produced in the plug. Accordingly, a communication plug should be designed to "optimize" rather than to minimize crosstalk. The term "optimize" is meant to convey that the crosstalk induced in a plug is controlled, and hence constant as compared to any other plug. Hence, if the induced NEXT in a plug is predictable, the jack can be accurately designed to compensate for that the anticipated NEXT induced in the plug.

In modular plugs currently in use, when the conductors are untwisted and inserted into the front of the plug housing, it is difficult to control their lengths, which, in turn, causes variation in electrical performance. This lack of precise control also leads in variations in electrical performance from plug to plug, whereas reproducibility of performance is a desideratum. In addition, an anchor bar is generally used to hold the cord or cable in the housing, and thereby provide strain relief. However, the anchor bar deforms the cable and introduces a random variable in performance, which is caused by the conductors being forced together at different stages of their twist. As a consequence, it is difficult to predict a plug's electrical characteristics, and the high degree of variability can result in reduced signal carrying performance in at least some of the circuits. This problem is discussed fully in U.S. Pat. No. 6,056,586 of Lin, issued May 2, 2000, the disclosure of which is herein incorporated by reference.

Also, in some current high frequency communication plugs, the conductors are terminated in the middle of the plug by insulation displacement connectors. The materials cost of the plug is greatly increased due to the amount of material such as phosphor bronze required by this type of structure. Also, in such a plug, the overall dimensions of the plug are increased, which hinders or prevents use of the plug in a confined place, such as high-density network hubs.

In addition, the technician time involved in the prior art practice of separating out the twisted pairs of conductors and routing them to their proper terminals in the plug is considerable. Even if the technician, splicer, or other assembly person is accurate in the disposition of the conductors, the time consumed by him or her in achieving such accuracy is considerable. Thus, the time spent in properly routing the conductors can add considerable cost. When it is realized that thousands of such connections are made daily, involving at least hundreds of technicians, it can be appreciated that any reduction in time spent in assembling the plug can be of considerable economic importance.

Accordingly, there exists a need for a modular plug that can terminate a standard round cable and that provides a straightforward interface between the conductors in the cable and the plug terminals, that involves less assembly time than heretofore, and which has substantially unvarying electrical characteristics from plug to plug.

One step toward achieving these goals is disclosed in U.S. Pat. No. 6,250,949 of Lin, issued Jun. 26, 2001, the disclosure of which is herein incorporated by reference. U.S. Pat. No. 6,250,949 provides a modular plug that can be easily assembled by a technician. The plug includes a conductor organizing sled, which controls the routing and placement of the twisted pairs of conductors inside the plug. The conductor organizing sled helps to ensure that the lengths of the individual conductors, and relative placements of the individual conductors, inside the plug is relatively consistent from plug to plug. Hence, the plug design disclosed in U.S. Pat. No.

6,250,949 helps to "optimize" the NEXT, so that the NEXT of the plug can be effectively reduced by a NEXT compensation scheme within a jack.

Such a plug has been well accepted in the industry and vastly employed. At CAT 5 standards, the plug design is completely acceptable at keeping NEXT within an acceptable level. However, there is always a trend toward faster transmission speeds and a further reduction of NEXT, such that future plug/jack combinations will need to reduce NEXT even further as performance standards increase (such as the minimum performance characteristics defined by future CAT standards).

SUMMARY OF THE PRESENT INVENTION

One solution would be to provide a new plug design. The new plug design would modify the orientation, spacing and/or the lengths of the conductors within the plug, so that NEXT produced in the plug would be even more tightly controlled. This solution would suffer drawbacks, since new master molds for the plug's component parts would need to be redesigned to accommodate the change in conductor orientation, spacing and/or lengths within the plug. Further, technicians, splicers, and other assembly persons would need to be retrained to assemble a new plug design.

It is an object of the present invention to provide a plug design which tightly controls the NEXT generated in a plug, so that only a minimum of variation occurs in the NEXT of one plug as compared to another plug. Moreover, it is an object of the present invention to provide a solution, which does not require retooling of the master molds used to form the component parts of the plugs already in existence. Further, it is an object of the present invention to provide a plug design which can be assembled in a like manner to the plug disclosed in U.S. Pat. No. 6,250,949, so that retraining of assembly persons is not required.

These and other objects are accomplished by a connector plug for terminating a communication cable having a plurality of conductors therein. The plug includes a conductor organizing sled, which includes a plurality of channels for separating conductive wires. The sled is formed of at least two materials, including a first material being a conductive material and a second material being a dielectric material. The first material may be a metal and the second material may be a plastic. In one embodiment, the first material is impregnated in the second material. In another embodiment, the first material is formed as a layer on an outer surface of the second material.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 7 is a table showing NEXT performance for a plug constructed in accordance with the Background Art;

FIG. 8 is a table showing NEXT performance for a plug constructed in accordance with a first embodiment of the present invention;

FIG. 9 is a table showing NEXT performance for a plug constructed in accordance with a second embodiment of the present invention, at a concentration of 10%; and FIG. 10 is a table showing NEXT performance for a plug constructed in accordance with the second embodiment of the present invention, at a concentration of 15%.

DETAILED DESCRIPTION OF THE PREFERRED EMBODIMENTS

In the following description, the terminating plug of the invention will be described as used with a cable commonly used in the art having four twisted pairs of insulated wires in a protective sheath typically of polyvinyl chloride (PVC) or other suitable material. Typically, the wires are identified by the color of their insulation, and the two wires of each pair are twisted about each other, and the pairs, in turn, are twisted about each other. It is well known in the art that such twisting of the wires and of the pairs serves to achieve a substantial reduction in crosstalk between individual wires and wire pairs within the cable. It is to be understood, however, that cables containing other numbers of wires and wire pairs can be terminated by plugs embodying the features and principles of the present invention. Also, such term as "bottom", "top", "front", "rear", and the like refer to orientations in the several figures, and not to any orientation that may occur in actual usage or practice.

Figures 1, 1B:
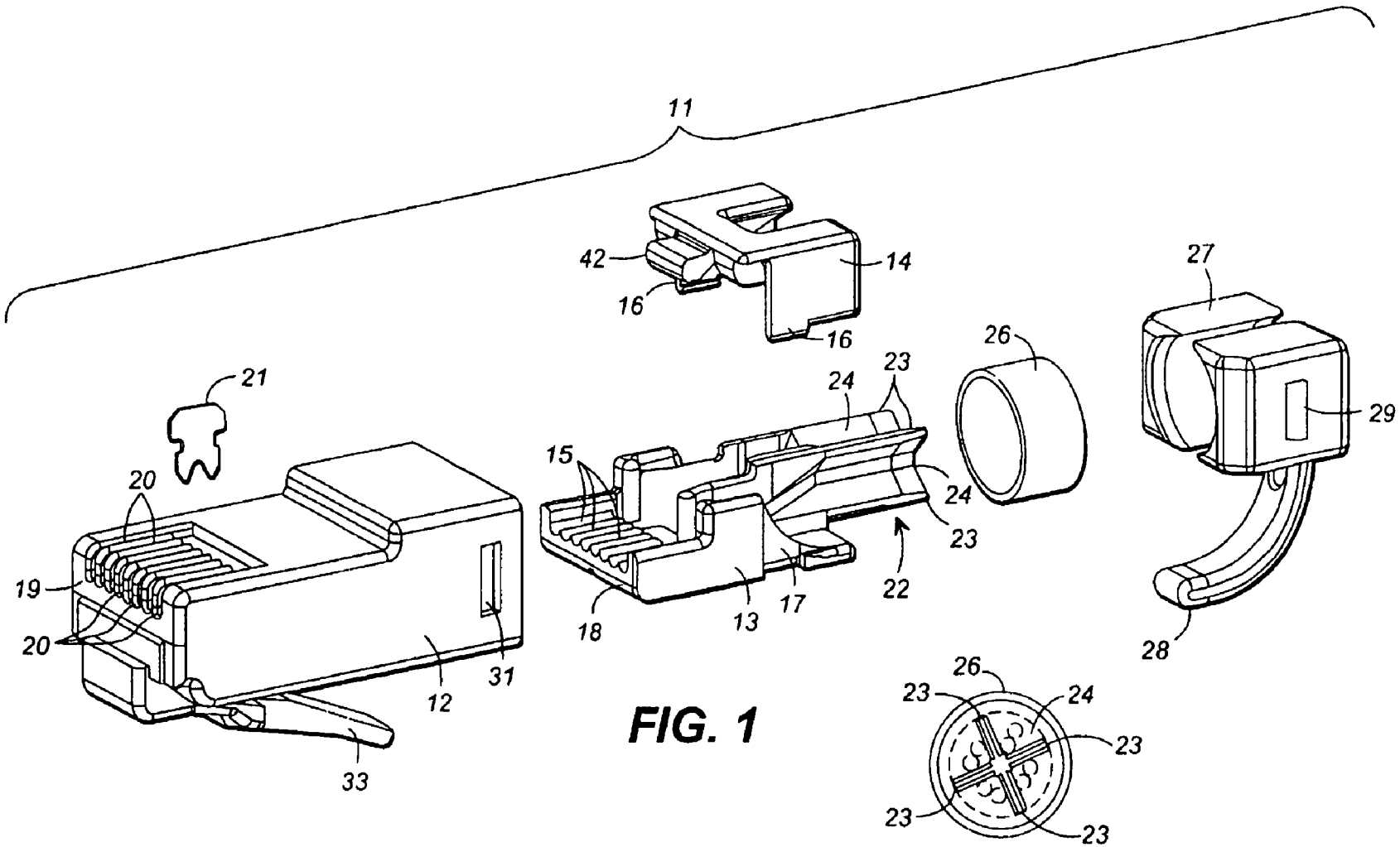
FIG. 1 is an exploded perspective view of the cable termination plug embodying the principles of the invention.
FIG. 1*b* is a cross-sectional view of the cruciform of the sled as inserted within the cable.

FIG. 1 is an exploded perspective view of the cable terminating plug 11 of the present invention, illustrating the several component parts thereof. Plug 11 comprises an outer housing member 12 having a hollow interior for housing a wire organizing sled 13. Preferably housing 12 is made of suitable dielectric (e.g., plastic) material. A cap or cover member 14, preferably of the same or similar material, has depending latch arms 16, the distal ends of which are configured to latch to the bottoms of slots 17 in sled 13. Sled 13, as can be seen, is an elongated member having a longitudinal axis and also having a flat floor portion and first and second side walls. The connector end 18 of sled 13 has a plurality of channels, such as parallel grooves 15 therein which, as will be discussed more fully hereinafter, are adapted to hold the several wires from the cable (not shown) in parallel relationship in a planar array. Housing 12 has, at its connector end 19, a conductor alignment region having a plurality (e.g., eight) slots 20 into which blade contact member 21 are insertable. Contact member 21 have sharp points for piercing the insulation of the wires lying in grooves 15 for making electrical contact therewith. Blades 21, in turn, are positioned in the slots 20 for making electrical contact with jack springs in the jack (not shown) for receiving the plug 11.

Sled 13 at its cable termination end 22 has four septa 23 arranged in a cruciform configuration to create four wire pair channels or passages 24, only two of which are shown, which are parallel to the longitudinal axis. The distance between the distal edges of oppositely disposed septa is slightly less than the inner diameter of the protective sheath of the cable, so that the cable end 22 of the sled may be inserted into the cable sheath. A crimping ring or ferrule 26 of suitable metallic material has an inside diameter sufficient to allow it to be slipped over the cable end with the sled inserted therein. When the ring 26 is crimped, the cable sheath is held tightly against the distal edges of the septa 23, thereby insuring strain relief by its resistance to longitudinal or axial forces as shown in FIG. 1*b*. Because of this unique strain relief arrangement the wires and wire pairs of the cable, being situated in the channels 24, are not subject to lateral forces that tend to distort their orientation with respect to each other, as is common in prior art devices. Such distortion can produce changes or increases in crosstalk between the wires which is unpredictable and, therefore, to be avoided.

A split wedge collar 27, having a curved anti-snag arm 28 depending therefrom is adapted to fit over the crimped end of the cable for insertion into housing 12, where it is latched in place by means of latch members 29 on either side thereof which fit into latching slots 31 in housing 12. When collar 27 is latched in place, the sled is locked in place within housing 12 and the plug is then, in essence, a single unitary structure.

Figure 2A:
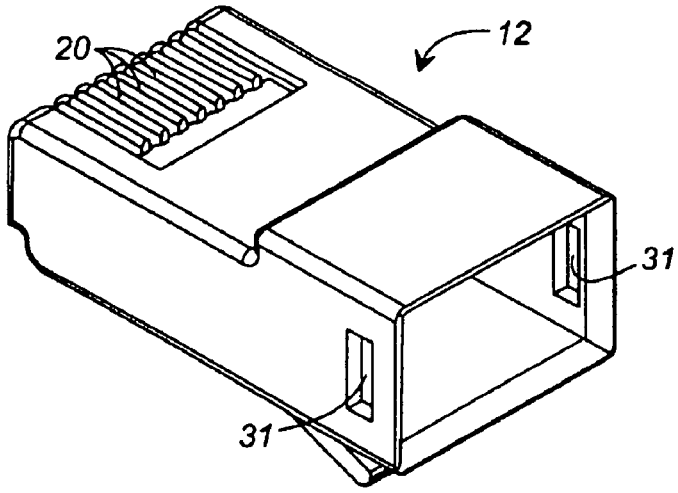
FIG. 2*a* is a perspective view of the housing of the plug of FIG. 1.
Figure 2B:
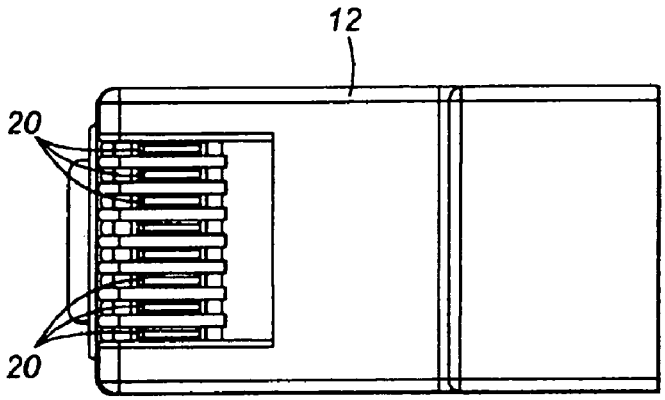
FIG. 2*b* is a top plan view of the housing.
Figure 2C:
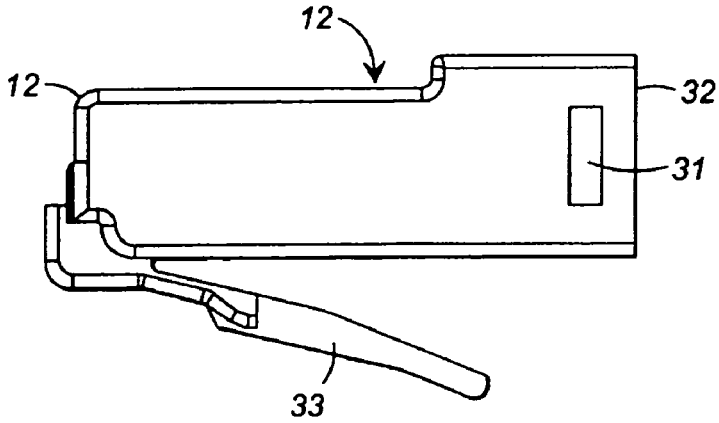
FIG. 2*c* is a side elevation view of the housing.
Figure 2D:
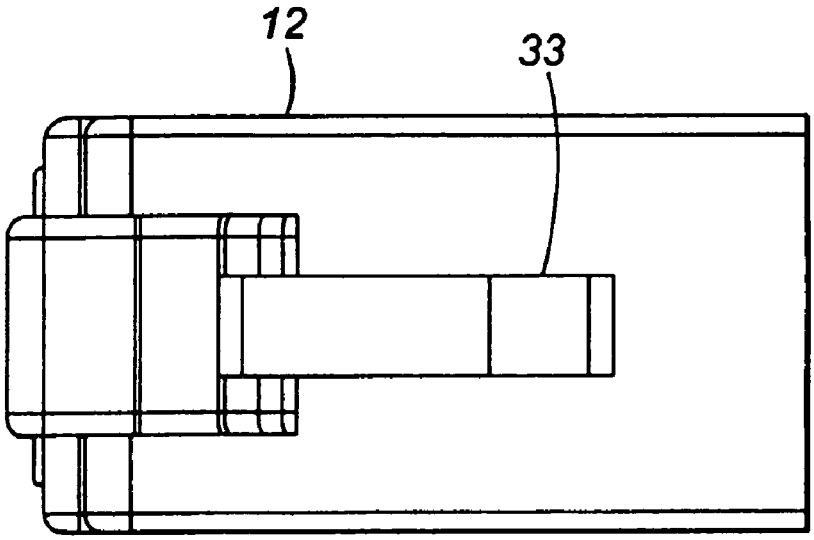
FIG. 2*d* is a bottom plan view of the housing.
Figure 2E:
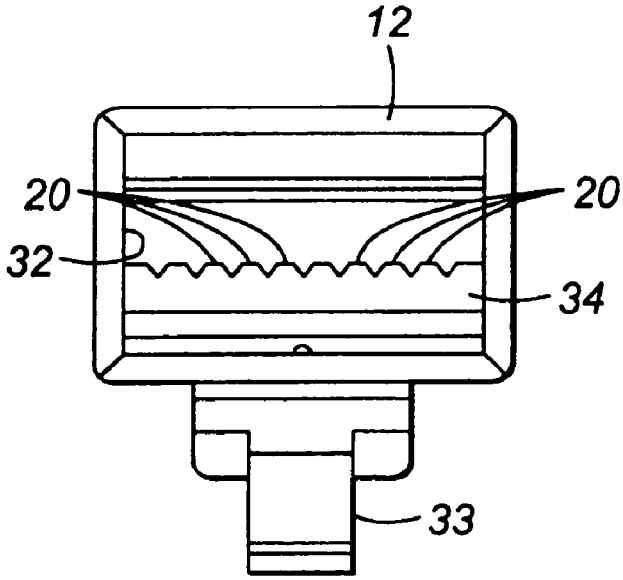
FIG. 2*e* is an end view of the rear of the housing.

FIGS. 2*a* through 2*e* are several views of the housing 12. Housing 12 has an opening 32 to its hollow interior, the opening 32 and the interior being sized to receive the sled 13 when inserted therein. A latching arm 33 depends from housing 32 in an angular orientation, as best seen in FIG. 2*c*, and is functional in locking and unlocking plug 11 from the jack or other receptacle into which it is inserted during use. In FIG. 2*e* can be seen the array of the bottom ends of slots 20, under which the connector end 18 of the sled 13 slides into a space 34.

Figure 3A:
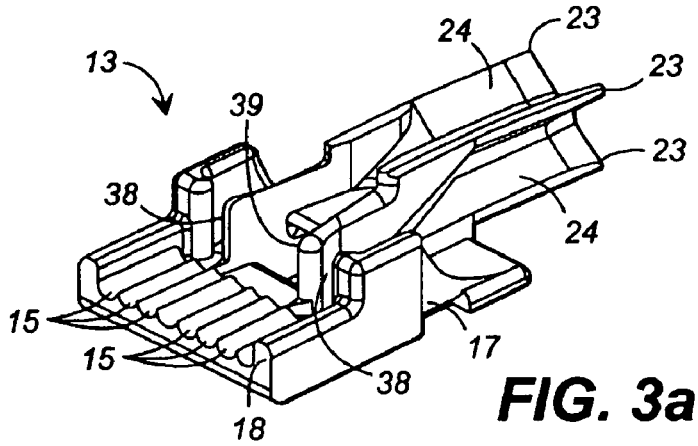
FIG. 3*a* is a perspective view of the sled of the invention.
Figure 3B:
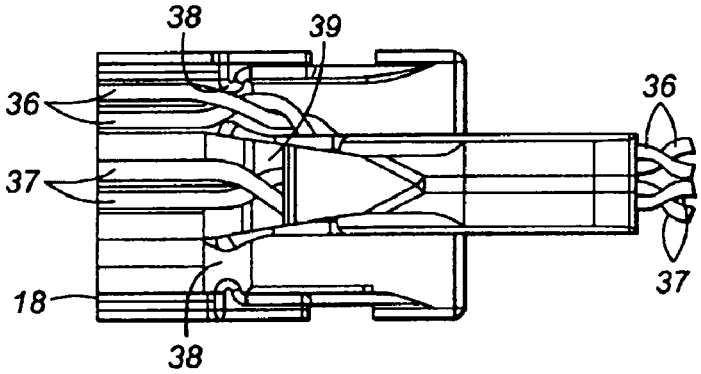
FIG. 3*b* is a top plan view of the sled.
Figure 3E:
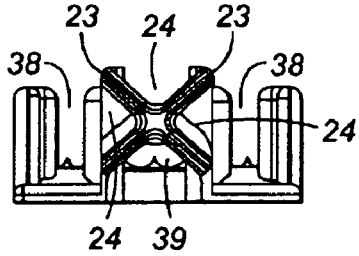
FIG. 3*e* is an end view of the rear end of the sled.
Figure 3C:
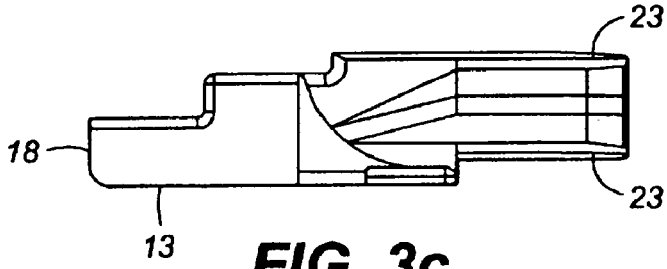
FIG. 3*c* is a side elevation view of the sled.
Figure 3D:
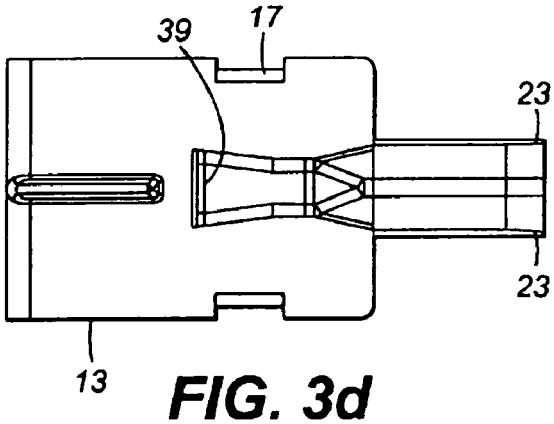
FIG. 3*d* is a bottom plan view of the sled.

FIGS. 3*a* through 3*e* are several views of the sled 13 of the present invention. In FIG. 3*b*, which is a top plan view of the sled 13, two twisted pairs of wires 36 and 37 are shown to illustrate the manner in which they are organized by sled 13. It is to be understood that the location of the pairs 36 and 37 in the grooves 15 is for illustrative purposes, and is not intended necessarily to be the particular grooves shown.

In FIG. 3*b*, the twisted pair 36 passes from the cable, not shown, through a side channel 24 (FIG. 3*a*), in which the twist is maintained, to a neck-down portion 38 at the end of the channel which forces the wires of pair 36 into a vertical alignment, i.e., one wire on top of the other. From the neck-down portion 38 the two wires are straight and parallel, lying in grooves 15, as can be seen. Thus, the twist in the pair is maintained up to the point where they are laid flat and parallel, thereby reducing the potential for crosstallk that would occur if they were straightened at a point in the sled before the neck-down portion 38. Both of the side channels 24 formed by the septa 23 have a neck-down portion 38. The top channel 24 does not have a neck-down portion, nor does the bottom channel 24 which is on the underside of the sled 13, and communicates with the grooves 15 through the opening 39. As pointed out hereinbefore, the two wires of pair 37 are shown lying in adjacent grooves 15. More often than not, depending upon which particular leads they represent, they will lie in separated grooves. However, the configuration of the sled makes it possible to organize the wires as is necessary for connection to the jack, while minimizing or, at least, controlling crosstalk, by minimizing the length of the non-twisted portions of the wire lengths. Some variations in crosstalk can be realized by changing the length of one or more of the parallel wires in the grooves 15, or by changing the length of the grooves themselves.

On either side of sled 13 are notches or slots 17 which receive the latching arms 16 of cap member 14 which latch to the bottoms of slots 17 to hold cap member 14 in place.

Figure 4A:
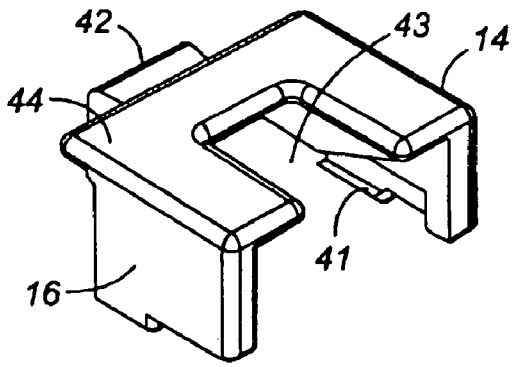
FIG. 4*a* is a perspective of the cap or cover for the sled of the invention.
Figure 4B:
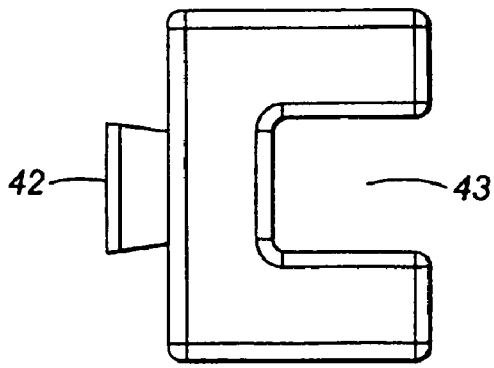
FIG. 4*b* is a top plan view of the cap.
Figure 4C:
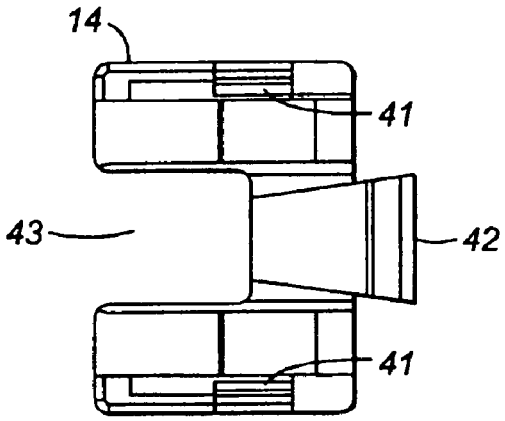
FIG. 4*c* is a bottom plan view of the cap.
Figure 4D:
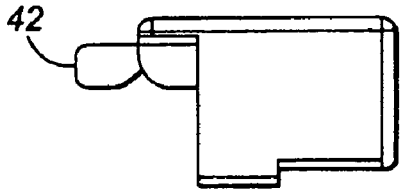
FIG. 4*d* is a side elevation view of the cap.
Figure 4E:
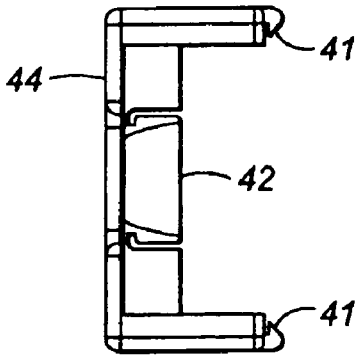
FIG. 4*e* is a rear end view of the cap.
Figure 5A:
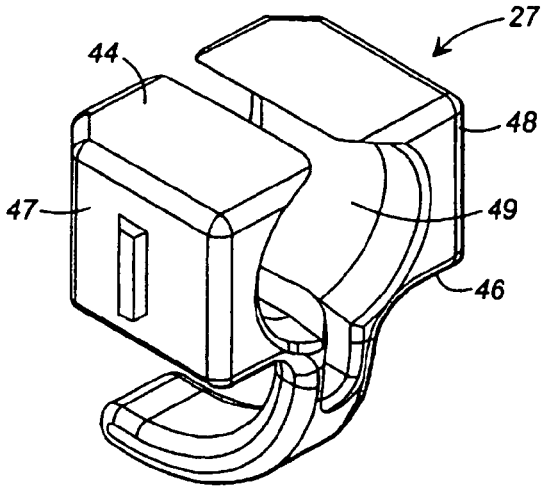
FIG. 5*a* is a perspective view of the split wedge collar of the invention.
Figure 5B:
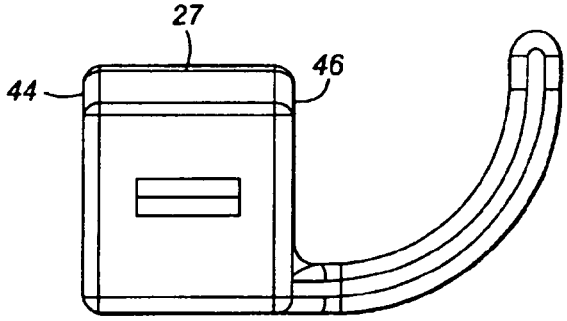
FIG. 5*b* is a side view of the collar.
Figure 5C:
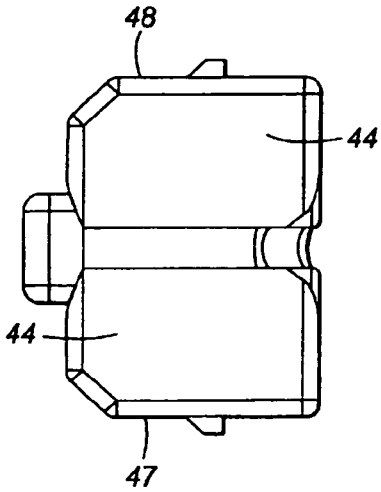
FIG. 5*c* is a bottom plan view of the collar.
Figure 5D:
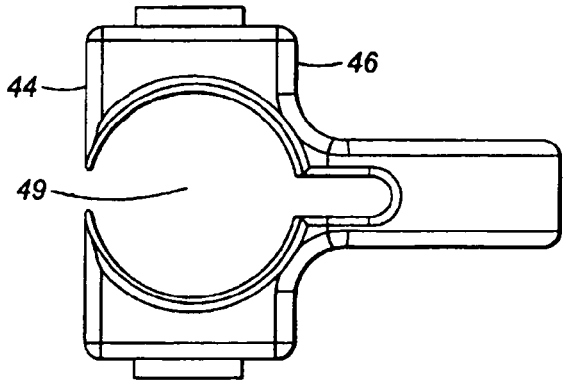
FIG. 5*d* is a front view of the collar.
Figure 6A:
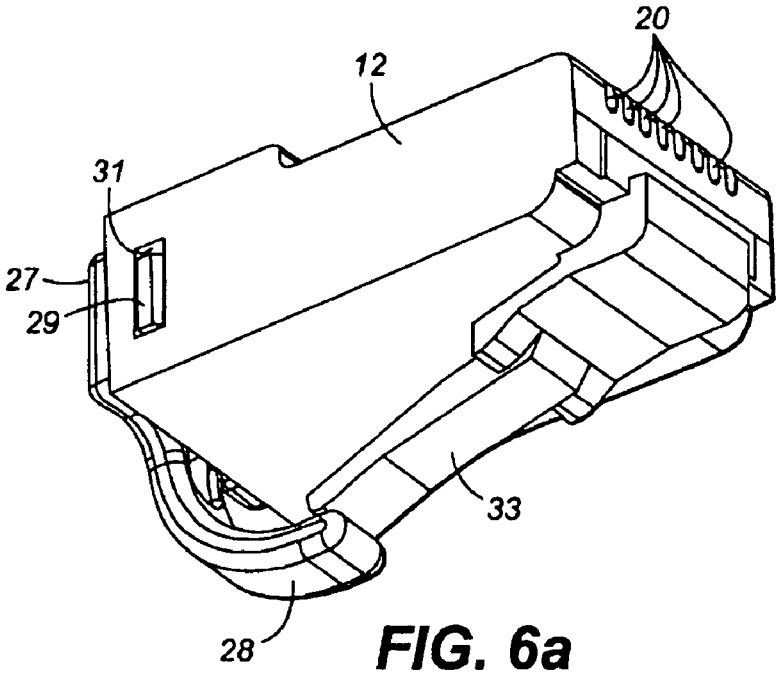
FIG. 6*a* is a perspective view of the assembled cable termination plug of the invention.
Figure 6B:
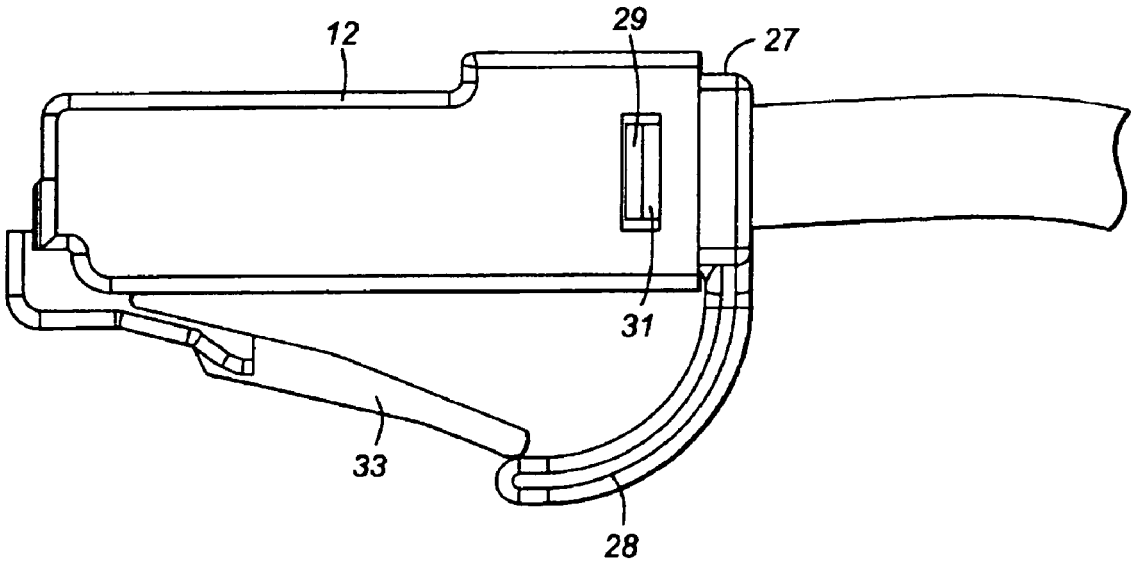
FIG. 6*b* is a side elevation view of the assembled plug.
Figure 6C:
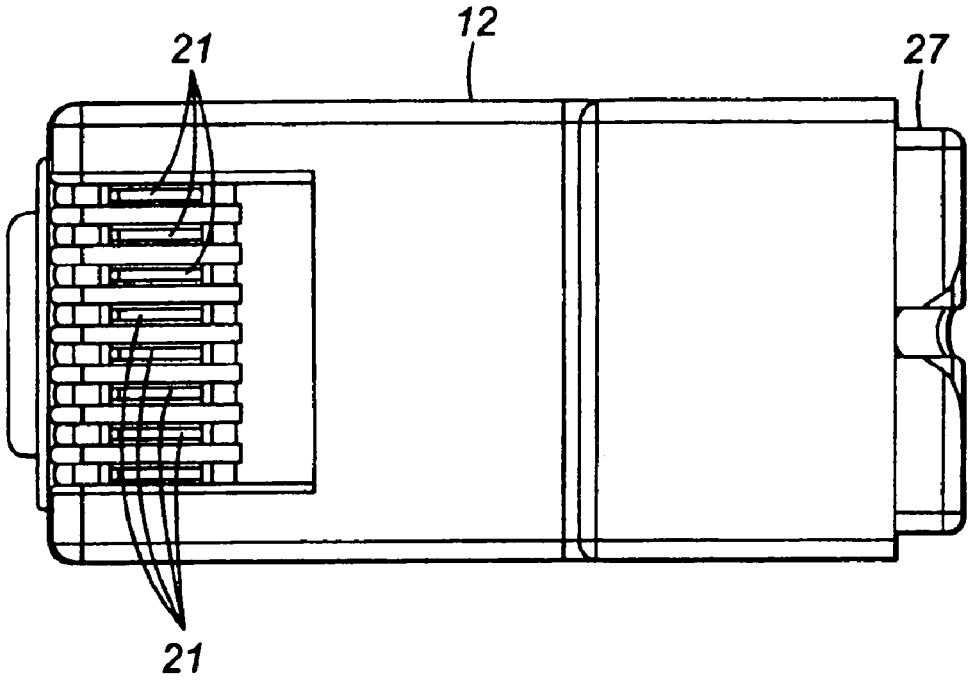
FIG. 6*c* is a top plan view of the plug.
Figure 6D:
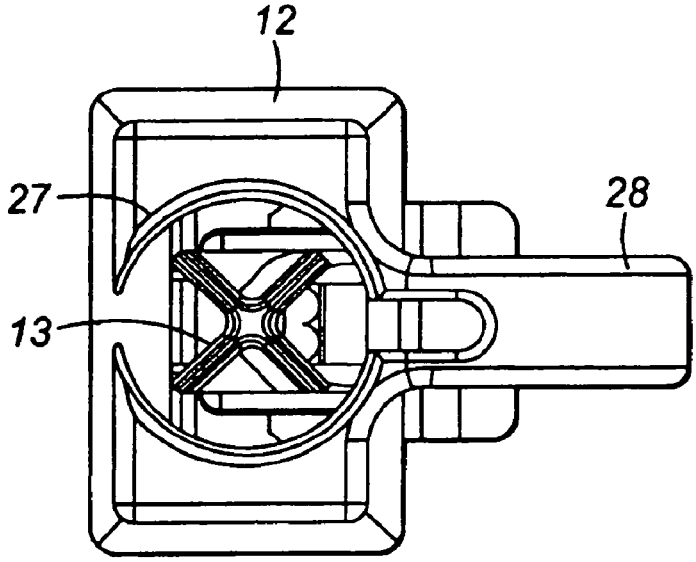
FIG. 6*d* is a rear end view of the plug.

Cap member 14 is shown in FIGS. 4*a* through 4*e* and, as shown in FIG. 4*a*, has depending sides or arms 16 which are designed to fit within the notches or slots 17 on sled 13. The bottom or distal end of each of arms 16 has a latching lip 41 which, when the cap 14 is placed on sled 13, latches to the bottom edge of slot 17. Cap 14 has an extension 42 which projects forwardly between the walls of sled 13 which are extensions of the top channel 24, and adds a measure of structural support thereto. Extension 42 also overlies the pair of wires which are directed from the bottom channel 24 of sled 13 through opening 39 to the grooves 15 and serves to prevent them from bulging upward. Cap 14 also has an open or recessed portion 43 in the top surface 44 thereof which provides visual access to the wire pair in the upper channel or passage 24 on sled 13.

FIGS. 5*a* through 5*d* are several views of the split wedge collar 27, which comprises a body of suitable plastic material having split top and bottom surfaces 44 and 46 joined by depending side walls 47 and 48. An opening 49 is formed in the body of collar 27 which is sized to fit over the cable and the crimping ring 26. Each of the side walls 47 and 48 has a latching projection 29 thereon designed and positioned to fit within latching slots 31 to hold collar 27 in place when it is pressed into housing 12. The splits in collar 27 permit it to be compressed when being inserted into housing 12, but even when the latching projections are seated in the slots 31, the collar 27 tightly grips the end of the cable, thereby anchoring it to sled 13 and to housing 12.

Depending from the lower or bottom of collar 27 is a curved anti-snag arm 28 which, as will be apparent hereinafter, functions to prevent latching arm 33 from snagging or being snagged and which also functions as an actuator for latching arm 33. Thus, pressure on arm 28 will be transmitted to latching arm 33 for inserting the plug 4 into a jack, or for removing it from the jack. Because of the small sizes of the plug and jack, it can be difficult for an installer to actuate arm 33. This difficulty is materially reduced by the action of anti-snag arm 28.

The assembled plug 11 of the invention is shown in FIGS. 6*a* through 6*d*. As can be seen, a cable 30, having the cruciform configured septa arrangement of sled 13 inserted therein, the crimping ring 26 crimped around the cable jacket, and the wedge collar 27 surrounding the crimped portion, is inserted into the rear of housing 12 until latch members 29 snap into latching slots 31. Anti-snag arm 28 rides over the distal end of latching arm 33 when wedge collar 27 is in place and, in this position, prevents inadvertent snagging of latching arm 33. It can be appreciated that, in addition, pressure on arm 28 will be transmitted to arm 33 to latch or unlatch the plug 11 relative to the jack.

The conductor organizing sled 13, as primarily illustrated in FIGS. 1, 1*b* and 3*a*-3*e*, was previously formed of a dielectric material (e.g. plastic), as recited in col. 4, lines 46-47 of U.S. Pat. No. 6,250,949. However, in accordance with the present invention, the sled 13 is "metallized," in that the sled is formed of at least two materials, including a first material being a conductive material, such as metal, and a second material being a dielectric material, such as a plastic.

By forming the sled 13 of two materials, including a conductive material, it is possible to provide some level of shielding or attenuation of crosstalk, between the twisted pairs in the area of the septa 23. It has been discovered that the resultant plug arrangement has a highly reproducible level of NEXT. In other words, there is remarkably little deviation in the NEXT measured between a given set of pairs in one plug as compared to the NEXT measured between the same set of pairs in another plug.

For example, FIG. 7 is a table showing the measured NEXT between pairs 1 and 2, pairs 1 and 3, and pairs 1 and 4, occurring within a plug constructed in accordance with U.S. Pat. No. 6,250,949. As can be seen in the table, the NEXT is most troublesome between pairs 1 and 3. This is due to the conductor ordering in the parallel grooves 15 of the conductor organizing sled 13. The maximum NEXT measured between pairs 1 and 3 in the plug sample was 14.88 mV, the minimum was 13.33 mV, and the average was 14.26 mV (Magnitude values are also provided in the table, wherein the magnitude value is stated in decibels (dB) and is equal to $\log_{10}$ of the mV value times (−20)). Most importantly, the standard deviation for the measured NEXT between pairs 1 and 3 was 0.35 mV, which demonstrates that there is a relatively large inconsistency in the induced NEXT between pairs 1 and 3 in one plug as compared to another plug.

An object of the present invention is to reduce the variation or standard deviation in NEXT in the plug. This is because a jack can be more easily engineered to accurately induce a given or fixed level of NEXT compensation, as compared to a plug. Typically, jacks will include a printed wiring board with crossed conductive traces, or interdiginated capacitors to induce the compensating NEXT. Such printed wiring boards are machine produced and can be easily replicated to produce a constant level of compensating NEXT in one jack as compared to another jack.

Plugs, on the other hand, are usually installed on a cut end of a wire by hand. The technician or assembly line worker must strip of portion of a surrounding jacket material, and carefully and consistently unwind a portion of the twisted wire pairs and insert them into the plug and fixed them to the plug's conductive terminals. Such human operators inevitably introduce variations in the manufacturing of the plugs, such that the NEXT of one plug will somewhat vary from the induced NEXT in the next plug. U.S. Pat. No. 6,250,949 illustrates a plug design that improves the consistency of the assembly process from plug to plug. However, as illustrated by the test data of FIG. 7, there is still a standard deviation of 0.35 mV in the measured NEXT in a given sample of thirty-four plugs, so constructed.

By the present invention, the conductor organizing sled 13 has been constructed to minimize the variation in NEXT induced between pairs 1 and 3 in the plug due to these variations introduced during the assembly process. In a first embodiment, the conductor organizing sled 13 is first formed of a dielectric material, such as plastic. Next, a portion of the sled 13 in the area of the septa 23 is plated with a conductive material, such as metal. The plating may be performed by a process, such as a vacuum metallizing procedure.

FIG. 8 is a table showing the measured NEXT between pairs 1 and 2, pairs 1 and 3, and pairs 1 and 4, occurring within a sample of eighteen plugs constructed in accordance with the first embodiment of the present invention. The septa area 23 of the sled 13 was coated with metal layers of stainless steel and copper, totaling approximately five microns in thickness. Although stainless steel and copper were used as the conductive layers in the test batch of plugs, other conductive materials could be employed such as carbon, aluminum, gold, or any other metals or alloys thereof.

As can be seen in FIG. 8, the maximum NEXT measured between pairs 1 and 3 in the plug sample was 14.36 mV, the minimum was 13.42 mV, and average was 13.97 mV (again Magnitude values are also provided in the table, wherein the magnitude value is stated in decibels (dB) and is equal to $\log_{10}$ of the mV value times (−20)). Most importantly, the standard deviation for the measured NEXT between pairs 1 and 3 in the first embodiment of the present invention was 0.28 mV. This is a twenty percent reduction in the standard deviation of 0.35 mV which corresponds to the plugs produced in accordance with the background art. The lower standard deviation means that on average the NEXT introduced in the plug can be more completely canceled by the compensating NEXT designed into the jack.

FIG. 9 is a table showing the measured NEXT between pairs 1 and 2, pairs 1 and 3, and pairs 1 and 4, occurring within a plug constructed in accordance with a second embodiment of the present invention. In the second embodiment, the sled 13 is formed by a molding process, such as a two shot molding process. The material used to mold the septa area 23 of the sled 13 is a mixture of a dielectric material, such as a plastic, and a conductive material, such as metal fibers. The material used to mold the grooves area 15 of the sled 13 is a dielectric material. In a test sample of twenty-six plugs, stainless steel fibers were dispersed or suspended within a plastic material forming the septa area 23 of the sled 13. Relative to a total weight of the sled 13, the stainless steel fibers constituted approximately 10% of the total weight, with the dielectric material constituting the remaining approximately 90% of the total weight. Although stainless steel fibers were used in the test sample of plugs, other conductive materials could be employed such as copper, aluminum, gold, carbon or any other metals or alloys thereof.

As can be seen in FIG. 9, the maximum NEXT measured between pairs 1 and 3 in the plug sample was 14.41 mV, the minimum was 13.36 mV, and average was 14.02 mV (again Magnitude values are also provided in the table, wherein the magnitude value is stated in decibels (dB) and is equal to $\log_{10}$ of the mV value times (−20)). Most importantly, the standard deviation for the measured NEXT between pairs 1 and 3 in the second embodiment of the present invention was 0.28 mV. This is again a twenty percent reduction in the standard deviation of 0.35 mV, which corresponds to the plugs produced in accordance with the background art. The lower standard deviation means that on average the NEXT introduced in the plug can be more completely canceled by the compensating NEXT designed into the jack.

FIG. 10 is a table showing the measured NEXT between pairs 1 and 2, pairs 1 and 3, and pairs 1 and 4, occurring within a plug constructed in accordance with a variation of the second embodiment of the present invention. In the variation of the second embodiment, the sled 13 is again formed by a molding process, such as a two shot molding process. However, instead of the septa area 23 of the sled 13 being formed with embedded stainless steel fibers at 10% of the total weight of the sled 13, the variation of the second embodiment has stainless steel fibers embedded in the septa area 23 of the sled 13 at 15% of the total weight of the sled 13.

As can be seen in FIG. 10, the maximum NEXT measured between pairs 1 and 3 in a test sample of thirty plugs was 14.33 mV, the minimum was 13.50 mV, and average was 13.88 mV. Most importantly, the standard deviation for the measured NEXT between pairs 1 and 3 in the second embodiment variation of the present invention was 0.22 mV. This is approximately a thirty-seven percent reduction in the standard deviation of 0.35 mV, common to the plugs produced in accordance with the background art. The lower standard deviation means that on average the NEXT introduced in the plug can be more completely canceled by the compensating NEXT designed into the jack.

In the second embodiment of the present invention, the conductive material was impregnated into the septa area 13 of the sled 13. However, it should be appreciated that more or less areas of the sled 13 could include the impregnated conductive material. It is the septa area 23 of the sled 13 which impacts mostly on the shielding or attenuation of the crosstalk between the closely spaced twisted pairs within the plug. However, it would be possible to imbedded the entire sled 13 with conductive material so long as care is taken in the area of the parallel grooves 15 to not create any conductive path between the conductors therein. This could be accomplish for example, by applying a nonconductive coating material to the parallel grooves 15. Therefore, it is within the spirit of the invention and scope of the appended claims that either the entire sled 13 is impregnated with the conductive material or only a portion of the conductive sled 13 is so impregnated, such as the area of the septa 23. Likewise, in the first embodiment of the present invention, it is within the spirit of the invention and the scope of the appended claims that either the entire sled 13 is plated with a conductive material or only a portion of the sled 13 is plated with the conductive material, such as the area of the septa 23.

Although the present invention has been described in connection with a plug configuration, as previously described in U.S. Pat. No. 6,250,949, it should be readily apparent that the teachings of the invention are equally applicable to other plug designs. For example, a sled, e.g. conductor organizer section, within another plug design could be metallized in accordance with the present invention to reduce the crosstalk produced within the plug. Hence, any plug design can benefit from the teachings of the present invention to further improve channel performance. By metallizing the conductor organizing sled, e.g. the portion of the plug holding or arranging the conductors within the plug, one can "optimize" the NEXT performance of the plug, so that the overall crosstalk performance of the plug/jack is improved, or so that an additional conductor pair can be added to the plug/jack.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connector plug for terminating a communication cable having a plurality of wire pairs therein, said connector plug comprising:

a one-piece conductor organizing sled having a plurality of channels adapted to hold wires from a cable in parallel relationship in a planar array at a connector end of said one-piece conductor organizing sled, and a plurality of septa creating wire pair passages at a cable termination end of said one-piece conductor organizing sled, wherein said one-piece conductor organizing sled is formed of at least two materials, including a first material being a conductive material and a second material being a dielectric material, and wherein said first material is impregnated into at least a portion of said second material.

2. The connector plug according to claim 1, wherein said first material is impregnated throughout an entirety of said second material.

3. The connector plug according to claim 1, wherein said first material constitutes approximately 10% or approximately 15% of a combined weight of said first material and said second material.

4. The connector plug according to claim 1, wherein said plurality of septa form an x-shaped cross section to create four wire pair passages.

5. The connector plug according to claim 1, wherein said plurality of septa create one open passage for each wire pair to enter at said cable termination end of said one-piece conductor organizing sled.

6. The connector plug according to claim 1, wherein said first material is a metal and said second material is a plastic.

7. The connector plug according to claim 6, wherein said first material is stainless steel or copper.

8. The connector plug according to claim 1, wherein said plurality of channels are parallel grooves.

9. The connector plug according to claim 8, wherein said parallel grooves are formed on one substantially flat surface of said conductor organizing sled.

10. A connector plug for terminating a communication cable having a plurality of wire pairs therein, said connector plug comprising:

a one-piece conductor organizing sled having a plurality of channels adapted to hold wires from a cable in parallel relationship in a planar array at a connector end of said one-piece conductor organizing sled, and a plurality of septa creating wire pair passages at a cable termination end of said one-piece conductor organizing sled, wherein said one-piece conductor organizing sled is formed of at least two materials, including a first material being a conductive material and a second material being a dielectric material, and wherein said first material is formed as a layer on at least a portion of an outer surface of said second material.

11. The connector plug according to claim 10, further comprising:

a housing having a first end with an opening therein for receiving said one-piece conductor organizing sled when said one-piece conductor organizing sled is attached to said housing, and a plurality of slots formed in a second end of said housing overlaying said plurality of channels.

12. The connector plug according to claim 10, further comprising:

a plurality of contact members, each contact member extending through one of said plurality of slots in said housing to make electrical contact with one of said individual conductors in said planar array.

13. The connector plug according to claim 10, wherein said first material is formed as a layer on an entirety of an outer surface of said second material.

14. The connector plug according to claim 10, wherein said layer of said first material is approximately 5 microns thick.

15. The connector plug according to claim 10, wherein said layer of said first material is applied to said second material by a vacuum metallizing process.

16. The connector plug according to claim 10, wherein said first material is a metal and said second material is a plastic.

17. The connector plug according to claim 16, wherein said first material is stainless steel or copper.

18. A connector plug comprising:

a conductor organizing sled;

a plurality of channels formed in said conductor organizing sled, said plurality of channels being capable of separating conductive wires, wherein said conductor organizing sled is formed of at least two materials, including a first material being a conductive material and a second material being a dielectric material, wherein said first material is impregnated into said second material or said first material is formed as a layer on an outer surface of said second material, and wherein said channels are parallel grooves, formed on one substantially flat surface of said conductor organizing sled; and a nonconductive coating material applied on said parallel grooves.

19. The connector plug according to claim 18, wherein said first material is a metal and said second material is a plastic.

20. The connector plug according to claim 19, wherein said first material is stainless steel or copper.

21. The connector plug according to claim 18, wherein said first material is impregnated throughout an entirety of said second material.

22. The connector plug according to claim 21, wherein said first material constitutes approximately 10% or approximately 15% of a combined weight of said first material and said second material.

* * * * *